US007398028B2

(12) United States Patent
Nakagaki

(10) Patent No.: US 7,398,028 B2
(45) Date of Patent: Jul. 8, 2008

(54) IMAGE HEATING APPARATUS INCLUDING A COOLING UNIT ADAPTED TO COOL A HEATING MEMBER

(75) Inventor: Jun Nakagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 11/338,263

(22) Filed: Jan. 24, 2006

(65) Prior Publication Data

US 2006/0177250 A1 Aug. 10, 2006

(30) Foreign Application Priority Data

Feb. 8, 2005 (JP) ..... 2005-031239

(51) Int. Cl.
*G03G 15/20* (2006.01)

(52) U.S. Cl. ..... 399/69; 399/320; 399/328; 399/329; 399/334

(58) Field of Classification Search ..... 399/69, 399/70, 94, 320, 328–331, 334, 341, 45; 219/216

See application file for complete search history.

(56) References Cited

U.S. PATENT DOCUMENTS

| | | | | |
|---|---|---|---|---|
| 4,512,650 | A * | 4/1985 | Kocher | 399/330 |
| 5,669,039 | A | 9/1997 | Ohtsuka et al. | |
| 6,345,169 | B1 * | 2/2002 | Haneda et al. | 399/328 |
| 7,072,609 | B2 * | 7/2006 | Karasawa | 399/94 |
| 7,280,795 | B2 * | 10/2007 | Kakishima et al. | 399/341 |
| 7,349,660 | B2 * | 3/2008 | Domoto et al. | 399/328 |

FOREIGN PATENT DOCUMENTS

| | | |
|---|---|---|
| JP | 1-121883 A | 5/1989 |
| JP | 6-149103 A | 5/1994 |

* cited by examiner

*Primary Examiner*—William J Royer
(74) *Attorney, Agent, or Firm*—Canon U.S.A. Inc. I.P. Division

(57) ABSTRACT

In an image heating apparatus including a rotatable heating roller to heat an image on a recording material at a nip part, and a cooling unit to cool the rotatable heating roller, the cooling unit includes a pipe that forms a cooling loop for circulating cooling fluid, and a heat transmission member provided slidably and rotatably around the pipe.

10 Claims, 7 Drawing Sheets

IMAGE HEATING APPARATUS INCLUDING A COOLING UNIT ADAPTED TO COOL A HEATING MEMBER

BACKGROUND OF THE INVENTION

1. Field of the Invention

The present invention relates to an image heating apparatus for heating an image on a recording material. This image heating apparatus is used in a copying machine, a printer, fax machine and so forth, which form an image, for example, by an electrophotographic method.

2. Description of the Related Art

In an electrophotographic image forming device, heat and pressure is applied, normally by a fixing apparatus, to a sheet bearing a transferred toner image to fix the toner image permanently to the sheet.

Specifically, a fixing roller including a heater in the inside and a pressurizing roller are arranged to contact each other under pressure so as to form a nip part, and the sheet is passed through the nip part to fix the toner image.

Further, for purposes of improving an energy consumption efficiency and enhancing a fixing characteristic, a fixing apparatus uses thin cylindrical films in place of the fixing roller and the pressurizing roller. Besides, instead of using the heater, another fixing apparatus performs an induction heating of a metallic member.

In any of such fixing apparatuses, when a sheet that is narrower than a heating region is used, heat is not absorbed from a non-sheet-passing region by the sheet while heat is absorbed from a sheet-passing region by the sheet. Consequently, the temperature at the non-sheet-passing region rises excessively.

This excessive temperature rise may accelerate deterioration of the rollers or the films. When a planar heater including a. ceramic material and the like is used as a base material, the excessive temperature rise may cause cracking in the heater. Besides, when a wide sheet is fixed after the temperature rise occurs, a drawback of high temperature offset occurs. In the high temperature offset, toners on the sheet attach to the fixing roller or the fixing film, and stain an image on the sheet where (mainly the non-sheet-passing region) the excessive temperature rise occurs.

In order to overcome these drawbacks, according to Japanese Patent Application Laid-Open No. 6-149103 (see corresponding U.S. Pat. No. 5,669,039A), when images are formed on narrow sheets continuously, the sheets are fed at extended intervals and power supply to a heater is cut off between the sheet feedings. In this manner, temperature falls at a non-sheet-passing part of a fixing apparatus.

Besides, in Japanese Patent Application Laid-Open No. 1-121883, a cooling roller through which fluid flows contacts a pressurizing roller to remove heat of the pressurizing roller so as to prevent temperature from rising excessively in a non-sheet-passing region at an end of a fixing apparatus.

However, the above-related art involve drawbacks as follows. In order to prevent excessive temperature rise in the non-sheet-passing region, the feeding intervals are extended. In that case, throughput (number of sheets output per unit time) may have to be reduced to ½ or less of normal throughput, depending on widths and numbers of the sheets. Therefore, productivity of an image forming device may decrease.

In the structure in which the cooling roller cools the pressurizing roller, the rotatable cooling roller itself contacts to the pressurizing roller. Therefore, it is required to prevent the fluid for cooling from leaking at a connecting portion between the cooling roller and a circulating pump for a long time period, and a structure for sealing at the connecting portion becomes complicated.

SUMMARY OF THE INVENTION

An aspect of the present invention is to overcome the above-described drawbacks.

Another aspect of the present invention is to provide an image heating apparatus capable of improving productivity resulting from excessive temperature rise of a heating rotor.

In one aspect of the present invention, an image heating apparatus includes a rotatable heating member configured to heat an image formed on a recording material at a nip portion; and a cooling unit adapted to cool the heating member. The cooling unit includes a pipe through which a cooling medium circulates, and the cooling member is slidably and rotatably disposed around the pipe.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Several embodiments, various features and aspects of the invention will be described in detail below with reference to the drawings. However, it is to be understood that the scope of the invention is not limited to sizes, materials, shapes, and relative arrangements, and the like of components described in the following embodiments, unless there exists any specific description. Material, shape, and the like of a member mentioned in a description also apply to other relevant descriptions that follow, unless they are described otherwise in particular.

Structure of Exemplary Image Forming Device

Figure 7:
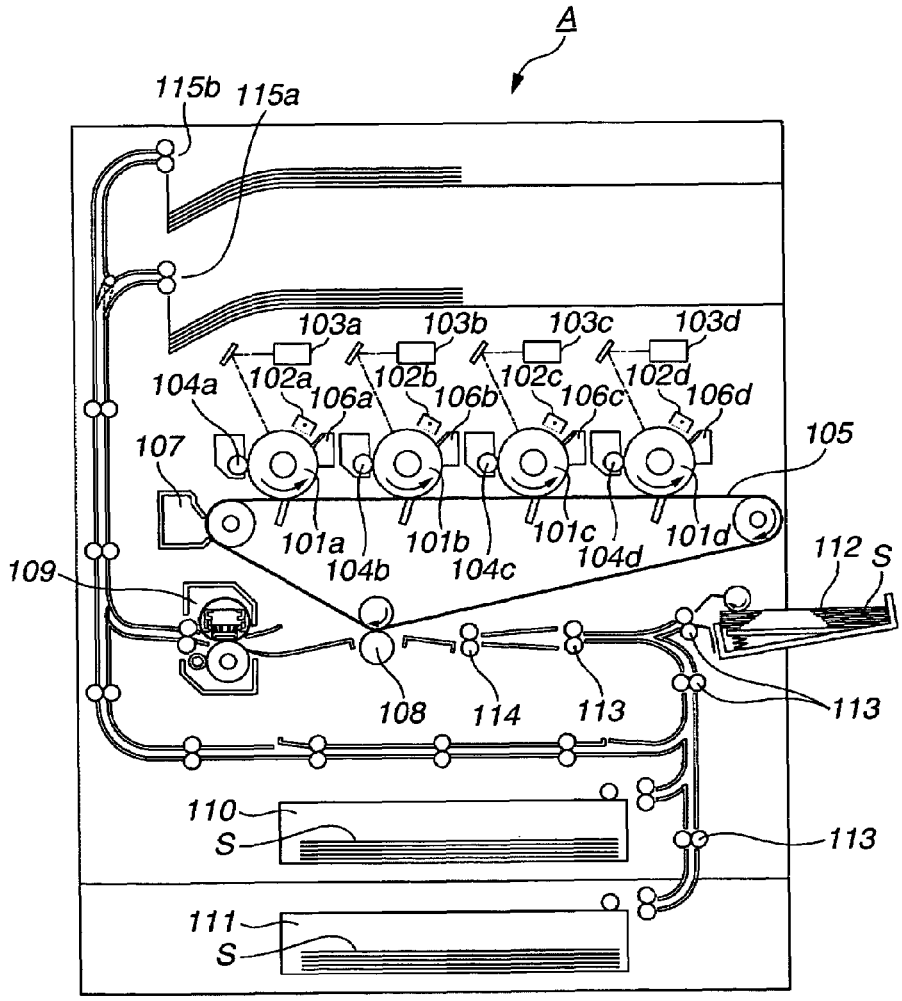
FIG. 7 is a sectional view of an exemplary electro-photographic image forming device which adopts the present invention.

First, with reference to FIG. 7, an exemplary structure of an electro-photographic image forming device in which at least some aspects the present invention are integrated thereto, is described.

An electrophotographic image forming device A (hereinafter referred to as "image forming device") may be, for example, a tandem color printer. Surfaces of four photosensitive drums (hereinafter referred to as "drums") 101*a*-101*d* are uniformly charged by electric chargers 102*a*-102*d*, respectively. Laser scanners 103*a*-103*d* are supplied with image signals of yellow, magenta, cyan and black, respectively, and irradiate the surfaces of the drums 101*a*-101*d* by laser lights according to these image signals so as to neutralize the electric charges and form latent images thereon.

The latent images formed on the drums 101*a*-101*d* are developed with toners of yellow, magenta, cyan and black by developers 104*a*-104*d*. The toners developed on the respective drums 101*a*-101*d* are transferred in turn onto an intermediate transfer member 105 so that a full color toner image is formed on the intermediate transfer member 105. The toner remaining on the drums 101*a*-101*d* after the transfer is recovered by cleaners 106*a*-106*d*.

A sheet S, such as paper, that is fed from either cassettes 110, 111 or a manual feed 112, is conveyed toward a resist roller 114 by a feeder roller 113. A leading edge of the sheet S hits against the resist roller 114 that is being stopped and forms a loop of the sheet S between the resist roller 114 and the feed roller 113. Then, the resist roller 114 starts to rotate in synchronization with the toner image on the intermediate transfer member 105.

The toner image on the intermediate transfer member 105 is transferred to the sheet S at a secondary transfer part 108. The toner image is fixed on the sheet S with pressure by a fixing apparatus 109 which heats an image on the sheet. Thereafter, the sheet S is carried out of the device A from a delivery part 115*a* or 115*b*. The toner that is not transfeffed at the secondary transfer part 108 and remaining on the intermediate transfer member 105 is recovered by a cleaner 107.

First Exemplary Embodiment

Figure 1:
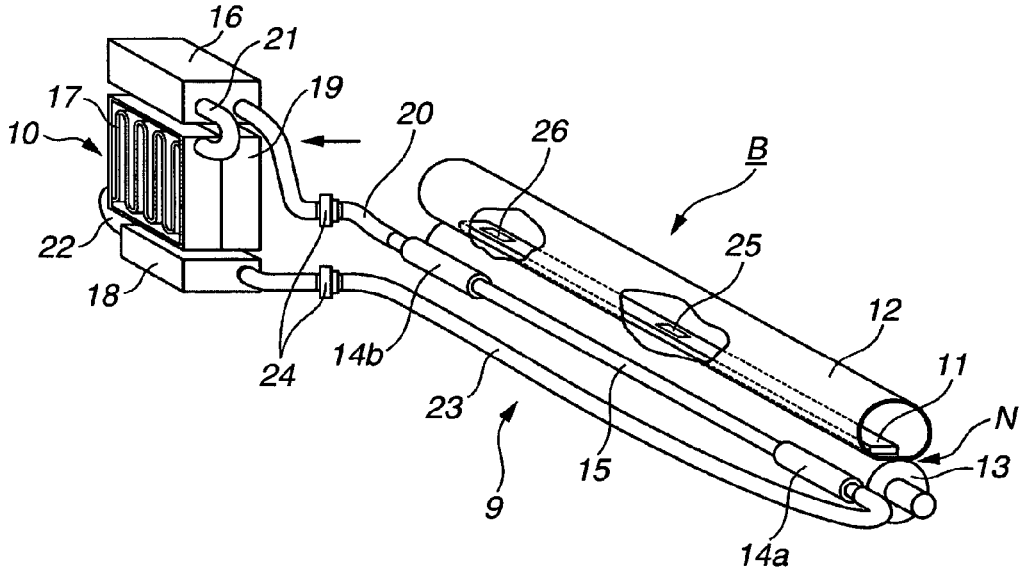
FIG. 1 is a schematic perspective view of the proximity of an exemplary fixing apparatus according to a first embodiment.
Figure 2A:
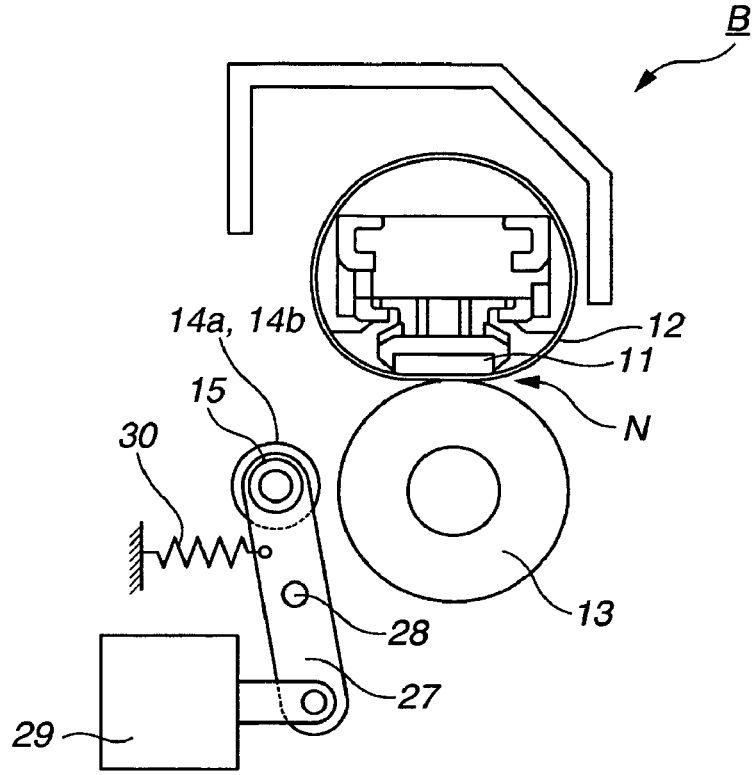
FIGS. 2A and 2B are sectional views of the proximity of the fixing apparatus according to the first embodiment.
Figure 2B:
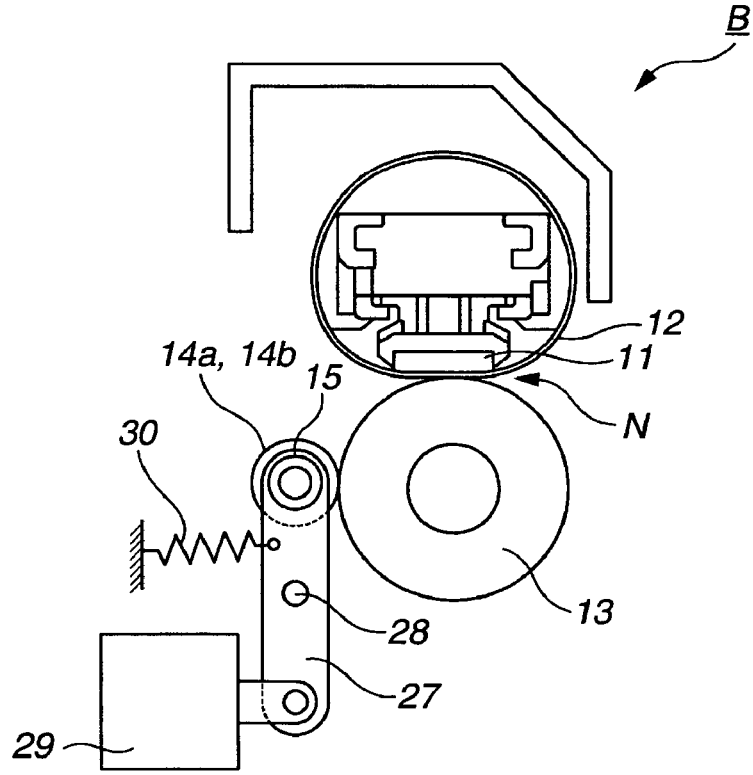

Next, with reference to FIG. 1, 2A and 2B, an exemplary fixing apparatus is described that heats an image on the sheet according to a first embodiment. FIG. 1 is a schematic perspective view of the proximity of the fixing apparatus according to the first embodiment. FIGS. 2A and 2B are sectional views of the proximity of the fixing apparatus according to the first embodiment.

Now referring to the aforementioned Figures, a fixing apparatus B includes a fixing film 12 as a heating rotor, a planar heater 11 as a heating member, a pressure roller 13 as a pressurizing roller, thermistors 25 and 26, and a heater holder (not shown). Also, it is noted that a pressurizing mechanism, and a frame of the fixing apparatus B are not shown for purposes of description.

The fixing film 12 may be a material of high thermal conductivity and low thermal capacity. The planar heater 11 may include a ceramic material as a base layer and heater patterns formed on a surface of the base layer. The planar heater 11 is placed in contact with an inner circumferential surface of the fixing film 12.

The pressurizing roller 13 is pressed to the planar heater 11 so as to sandwich the fixing film 12 therebetween, and to form a fixing nip N that fixes the image on the sheet S. According to the present embodiment, the fixing film 12 and the pressurizing roller 13 constitute the fixing nip N. A fixing roller (heating roller) which surface is made of rubber, and a halogen heater located inside the fixing roller may also be used in place of the fixing film 12 and the planar heater 11. The sheet S bearing the transferred toner image is passed through the fixing nip N to be heated and pressurized, while the toner is fixed on the sheet S.

The planar heater 11 according to the present embodiment includes two heaters, e.g. a heater pattern a heating region of A3 size in horizontal width (297 mm) and heater pattern having a heating region of A6 size in horizontal width (105 mm). Accordingly, the planar heater 11 can be energized and heated selecively.

Metallic rollers 14*a* and 14*b*, which function as heat transmission members (cooling members), are arranged in the proximity of both ends of the pressurizing roller 13 in a longitudinal direction. The rollers 14*a* and 14*b* are rotatably supported about the longitudinal axis of a metallic pipe 15. The metallic pipe 15 is disposed parallel to the longitudinal direction of the pressurizing roller 13.

The roller 14*a* and 14*b* contact the pressurizing roller 13 in regions from the outside of 210 mm width of A5 size sheet to the ends of the pressurizing roller 13. That is, the rollers 14*a* and 14*b* are arranged so as to contact the non-sheet-passing regions at the ends of the pressurizing rollers 14*a* and 14*b* do not contact the sheet-passing region in the central part of the pressurizing roller 13. Thus, the rollers 14*a* and 14*b* are configured to absorb heat from the non-sheet-passing regions, but not from the sheet-passing region.

The sheet-passing part of the pressurizing roller 13 that fixes the image is a region through which not only a sheet of maximum size (A3 size in horizontal width in the present embodiment) passes that can be fixed by the image forming device A, but also a sheet of a size (A5 size in horizontal width in the present embodiment) passes that is smaller than the sheet of the maximum fixable size. On the other hand, the non-sheet-passing parts of the pressurizing roller 13 are regions through which a sheet of the maximum size (i.e. A3 size in width according to the present embodiment) passes that can be fixed by the image forming device A, but a sheet of a size (i.e. A5 size in horizontal width according to the present embodiment) does not pass that is smaller than the sheet of the maximum fixable size.

The non-sheet passing parts are subjected to the higher temperature rise than the sheet-passing part at the center of the pressurizing roller 13. However, even when sheets of small sizes, such as A5 size, are fixed continuously, the non-sheet-passing parts at the ends of the pressurizing roller 13 can be cooled selectively by the rollers 14*a* and 14*b*. Therefore, as compared with a case where the whole pressurizing roller 13 is cooled, the heat is not absorbed from the sheet-passing part that does not have to dissipate the heat. Thus, power consumption can be reduced.

In the present embodiment, the sheet-passing part and the non-sheet-passing parts are determined relative to the center in the longitudinal direction of the pressurizing roller 13; however, the image forming device A may also determine a sheet-passing part and a non-sheet-passing part relative to one end in the longitudinal direction of the pressurizing roller 13. In this case, the non-sheet-passing part is located at the other end of the pressurizing roller 13; therefore, it becomes unnecessary to provide a plurality of heat transmission members 14*a* and 14*b*, and thus, the structure can be simplified.

The rollers 14*a* and 14*b* can be made as thin as possible to reduce thermal capacity. Grease that contains silicone or the like can be applied to sliding surfaces between the rollers 14*a*, 14*b* and the metallic pipe 15 so as to improve sliding characteristics and increase thermal conductivity.

The metallic pipe 15 is supported by an arm 27 as a turning member that can turn around a fulcrum 28, as shown in FIGS. 2A and 2B. One end of the arm 27 is connected to a solenoid 29. Also, a spring 30 is attached to the arm 27. The spring 30 is configured to bias the arm 27 in a direction that the rollers 14*a* and 14*b* take to separate from the pressurizing roller 13. When the solenoid 29 is energized, the arm 27 moves from a state shown in FIG. 2A to a state shown in FIG. 2B, and the rollers 14*a* and 14*b* contact the pressurizing roller 13. When the energization of the solenoid 29 is stopped, the arm 27 is drawn by the spring 30 around the fulcrum 28 so as to turn the metallic pipe 15, and thereby, separates the rollers 14*a* and 14*b* from the pressurizing roller 13.

One end of the metallic pipe 15 is connected to a reservoir tank 16 (see FIG. 1) via a tube 20, and the reservoir tank 16 is connected to a radiator 17 that serves as a heat dissipating member via a tube 21.

A downstream outlet of the radiator 17 is connected to a pump 18 via a tube 22. A downstream outlet of the pump 18 is connected to the other end of the metallic pipe 15 via a tube 23. A cooling loop 9 is thus formed, and antifreeze solution (fluid) that contains ethylene glycol or the like is enclosed inside the cooling loop 9 as a cooling medium. That is, the metallic pipe 15 functions as a part of the cooling loop 9 through which the fluid flows through to transfer heat from the rollers 14*a* and 14*b* to the outside environment via radiator 17 which is part of a heat exchanger or cooling mechanism 10.

The cooling mechanism 10 further includes the pump 18 for circulating the fluid in the cooling loop 9 and the radiator 17 that dissipates the heat of the fluid to the outside environment of the cooling loop 9. Thus, the cooling mechanism 10 can efficiently dissipate the heat absorbed by the rollers 14*a* and 14*b* out of the device, and prevent degradation of cooling capacity due to the temperature rise of the rollers 14*a* and 14*b*. Thereby, small size sheets can be fixed continuously in larger numbers, and reduction in productivity can be prevented that accompanies the temperature rise at the ends.

A pipe is formed inside the radiator 17, as shown in FIG. 1. The pipe meanders inside the radiator 17 a number of times to increase a surface area contacting open air. The radiator 17 is placed in the proximity of an exterior surface of the image forming device A, and a fan 19 is provided on an inner side of the radiator 17. The fan 19 blows air in a direction indicated by an arrow shown in FIG. 1, and thereby transfers the heat from the cooling medium flowing inside the radiator 17 out of the image forming device A (see FIG. 7).

With such arrangement of the rollers 14*a* and 14*b*, movable parts can be eliminated from the cooling loop 9. Therefore, the device structure is considerably more simple and the cooling medium can be prevented from leaking from the connecting parts between the members.

On the same side in the longitudinal direction of the fixing apparatus B, quick-disconnects or one-touch joints 24 are attached near each end of the tubes 20 and 23. Each of the one-touch joints 24 includes a valve in the inside. The inside valve closes when a joint part (connection part) is disconnected. Therefore, by disconnecting the one-touch joint 24, the cooling loop 9 can be disconnected without leaking of the inside cooling fluid and/or medium.

In the present embodiment, the rollers 14*a* and 14*b* are composed of the roller 14*a* that contacts the pressurizing roller 13 at one end in the longitudinal direction and the roller 14*b* that contacts the pressurizing roller 13 at the other end. The metallic pipe 15 that supports the roller 14*a* and the roller 14*b* is connected in series to the cooling mechanism 10.

Therefore, in the case of replacing or maintaining the fixing apparatus B, the cooling loop 9 can be easily isolated by disconnecting the one-touch joints 24. Thus, the fixing apparatus B can be removed from the image forming device A in a state where the constituent members, such as the reservoir tank 16, the radiator 17 and the pump 18, remain in the image forming device A. Especially, in the case of replacing the fixing apparatus B, the radiator 17 and the pump 18 that are expensive do not need to be replaced, and accordingly, the maintenance cost of the image forming device A can be largely reduced.

As shown in FIG. 1, the thermistors 25 and 26 are disposed on the planar heater 11 in the proximity of its center and one end in the longitudinal direction, respectively, so that temperature in each position can be detected.

In the case of image-forming of A3 horizontal size and A4 longitudinal size, the heater pattern of A3 size in horizontal width (297 mm) may be energized. In the case of image-forming of A6 horizontal size (postcard) and so forth, the heater pattern of A6 size in horizontal width (105 mm) may be energized.

In other words, the fixing film 12 has the two heater patterns having different lengths in the longitudinal direction. When a sheet to be fixed is substantially identical in size to the shorter heater pattern of the above two heater patterns, the sheet is fixed using the shorter heater pattern of the above two heater patterns. Accordingly, the non-sheet-passing parts of the sheet is free from the excessive temperature rise.

On the other hand, a case of feeding A5 size longitudinally (i.e. shorter in a feeding direction) is described below. Here, since the heater of A6 size in horizontal width (105 mm) cannot cover A5 longitudinal size (210 mm), the heater of A3 size in horizontal width (297 mm) needs to be used. However, in this case, a passing region (sheet-passing part) of the sheet S is narrower than the heating region of the heater.

In the sheet-passing region, the sheet S removes heat from the fixing film 12 and the pressurizing roller 13. On the other hand, in the non-passing region (non-sheet-passing part) of the sheet S, heat of the fixing film 12 and the pressurizing roller 13 is not directly removed. Therefore, when the sheets are continuously fed, the heat is accumulated and a temperature difference between the thermistors 25 and 26 is detected.

When a control device (not shown) determines that this temperature difference is larger than a predetermined level, the control device energizes the solenoid 29 so that the rollers 14*a* and 14*b* contact the pressurizing roller 13, as shown in FIG. 2B. In addition, the pump 18 activates and the cooling medium enclosed in the cooling loop 9 starts to circulate. Simultaneously, the fan 19 starts to rotate. The pump 18 that constitutes a circulation mechanism may be configured to switch between operation and non-operation according to a widthwise length (i.e. length in a direction substantially perpendicular to the sheet feeding direction) of the sheet S.

The heat accumulated in the non-sheet-passing parts at the ends of the pressurizing roller 13 is transferred to the cooling medium in the metallic pipe 15 via the rollers 14*a* and 14*b* and the metallic pipe 15 and the heat at the ends of the pressurizing roller 13 decreases.

The cooling medium removes the heat at one end of the pressurizing roller 13 via the roller 14*a* disposed at an end of the fixing apparatus B, flows in the metallic pipe 15, and similarly removes the heat at the other end of the pressurizing roller 13 via the roller 14*b* disposed at the other end of the fixing apparatus B. The cooling medium is sent to the radiator 17 via the reservoir tank 16. In the radiator 17, the heat of the cooling medium is transferred to a wall of the water pipe, and is emitted out of the device by the fan 19, and thereby, the temperature of the cooling medium falls. Then, the cooling medium circulates to the pump 18 and through the metallic pipe 15 again.

By the circulation of the cooling medium, the heat accumulated excessively at the ends of the fixing apparatus B is emitted out of the device. When the temperature difference between the thermistors 25 and 26 is eliminated, the energization of the solenoid 29 is canceled. Then, the metallic pipe 15 rotatably supporting the rollers 14*a* and 14*b* moves being urged by the spring 30 as shown in FIG. 2A so that the rollers 14*a* and 14*b* are separated from the pressurizing roller 13. In addition, the pump 18 and the fan 19 stop rotating.

By the above operation, the excessive temperature rise at the end of a fixing apparatus B can be stopped, and a reduction in the productivity resulting from a reduction in throughput can be improved.

As compared to a case where the fluid flows in and flows out to/from a rotating part, the cooling loop 9 is provided, not in the rollers 14*a* and 14*b* serving as rotating heat transmission members, but in the metallic pipe 15 serving as a fixed supporting member. Accordingly, a sealing characteristic can be easily secured and the fluid in the inside does not leak.

According to the present embodiment, the rollers 14*a* and 14*b* can be separated from the pressurizing roller 13. Therefore, even when the fixing apparatus B is heated and goes from a cooled condition to a warmed condition in which a wide sheet such as A3 horizontal size becomes fixable, the cooling medium is not heated and does not produce a superfluous amount of heat. Therefore, no adverse influence is exerted on a start-up time of the image forming device A.

According to the present embodiment the cooling medium starts circulating when the difference in temperature detected by the two thermistors 25 and 26 in the fixing apparatus B becomes larger than a predetermined value; however, the cooling mediumm ay be configured to start to circulate according to a method as described below.

For example, the cooling medium may be configured to start to circulate when the temperature of the thermistor 26 provided at the end of a device exceeds a predetermined value. In this manner of controlling, it is not necessary to calculate a temperature difference in a plurality of the thermistors, and thus, simple controlling becomes possible. Alternatively, the cooling medium may be configured to start to circulate when a number of narrow sheets on which images were formed exceeds a predetermined value. In this controlling method, conditions on which the cooling medium starts to circulate are stored beforehand in the form of the size of sheets to be fed or numbers of sheets on which images are formed. When the conditions are fulfilled, the cooling medium starts to circulate. Therefore, a unit for directly measuring temperature can be omitted, and a parts and assembly cost can be reduced.

According to the present embodiment, the heater patterns of the planar heater 11 have A3 size in horizontal width (297 mm) and A6 size in horizontal width (105 mm), and the rollers 14*a* and 14*b* are affanged outside the region where A5 size in longitudinal width (210 mm) and A3 size in horizontal width (297 mm) overlap with each other. But the present invention is not limited to these values.

Other structures may be adopted: for example, the planar heater 11 includes only the heat pattern of A3 size in horizontal width (297 mm), and the rollers 14*a* and 14*b* are affanged outside the region where A5 size in horizontal width (148.5 mm) and A3 size in horizontal width (297 mm) overlap with each other.

According to the present embodiment, the rollers 14*a* and 14*b* serving as the heat transmission members contact the pressurizing roller 13. However, the heat transmission members may be affanged so as to contact the fixing film 12 including a heater 11.

Second Exemplary Embodiment

Figure 3:
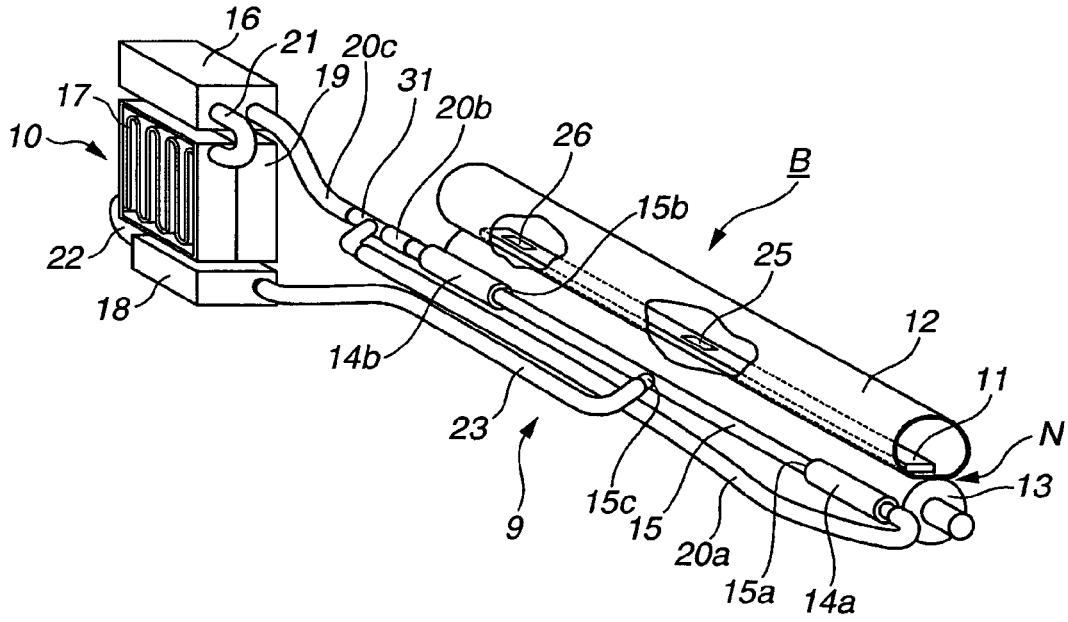
FIG. 3 is a schematic perspective view of the proximity of an exemplary fixing apparatus according to a second embodiment.
Figure 4:
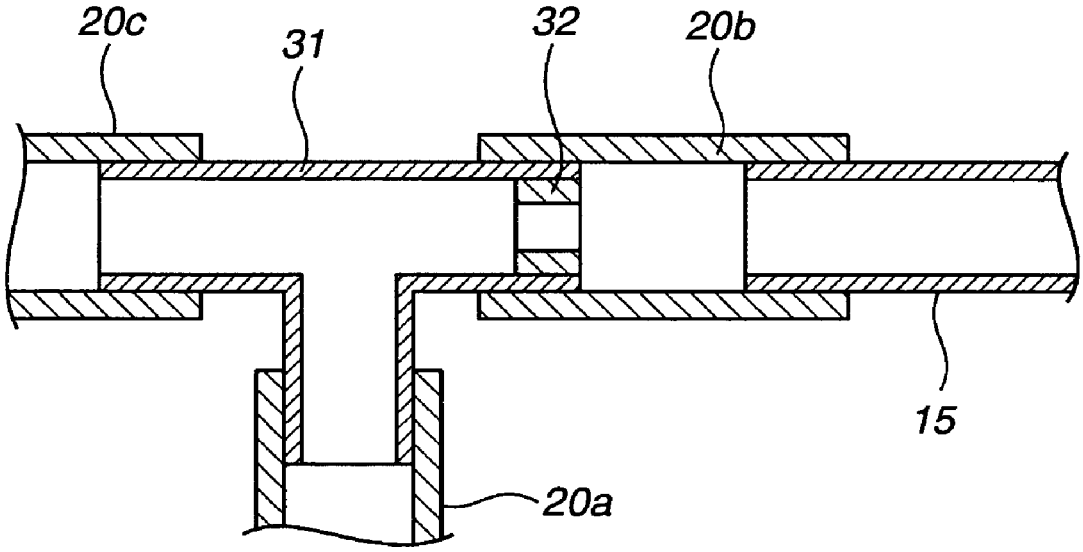
FIG. 4 is a sectional view of exemplary channels in the proximity of a coupling arranged in the channels.

Next, a fixing apparatus B according to a second embodiment is described with reference to FIGS. 3 and 4. FIG. 3 is a schematic perspective view of the proximity of the fixing apparatus B according to the second embodiment. FIG. 4 is a sectional view of piping/and or conduit in the proximity of a coupling 31 arranged in the cooling loop 9. Parts identical or equivalent to the first embodiment will not be described in the following description.

In the present embodiment, one end of the metallic pipe 15 is connected to the coupling 31 via a tube 20*a*. The other end of the metallic pipe 15 is connected to the coupling 31 via a tube 20*b*. The coupling 31 is connected to the reservoir tank 16 via a tube 20*c*.

The reservoir tank 16 is connected to the radiator 17 via the tube 21. A downstream outlet of the radiator 17 is connected to the pump 18 via the tube 22. Then, a downstream outlet of the pump 18 is connected via the tube 23 to an inlet 15*c*. The inlet 15*c* is provided in a middle of the metallic pipe 15 between a portion rotatably supporting the roller 14*a* and a portion rotatably supporting the roller 14*b*.

According to the present embodiment, a portion 15*a* supporting the roller 14*a* and a portion 15*b* supporting the roller 14*b* are connected in parallel to the cooling mechanism 10 described in the first embodiment. Further, as shown in FIG. 3, as to lengths of piping/conduits from the cooling medium inlet 15*c* of the metallic pipe 15 to the coupling 31, the piping passing through the roller 14*a* is longer than the piping passing through the roller 14*b*. When the piping lengths thus differ, the cooling medium flows more easily through the piping having the shorter length. Therefore, as shown in FIG. 4, a diaphragm 32 serving as a flow regulating device is formed on the side of the coupling 31 connected with the tube 20*b*, as shown in FIG. 4. The diaphragm 32 is configured such that flow rates of the fluid flowing through the roller supporting portion 15*a* and the roller supporting portion 15*b* are substantially equal if so desired.

By adopting an appropriate diameter for the diaphragm 32, the rates of the flow that passes through the portions 15*a* and 15*b* supporting the rollers 14*a* and 14*b* respectively can be equalized. Thereby, capabilities of cooling the pressurizing roller 13 via the two rollers 14*a* and 14*b* can be made equal at both ends of the device.

Thus, the piping/conduits (pipe/tube) 15, 20*a* are arranged in parallel so that the cooling medium having absorbed heat at the portion 15*a* supporting the roller 14*a* does not pass the portion 15*b* supporting the roller 14*b* before passing through the radiator 17. Therefore, the cooling medium having absorbed heat at one of the support portions 15*a* and 15*b* does not reach the other support portion 15*a* and 15*b*. Thus, heat transmission capacities at both support portions 15*a* and 15*b* can be substantially equal if so desired.

Further, by effecting the uniform flow rates through each pipe portion, it becomes possible that temperature at both ends of the fixing apparatus B falls almost uniformly as compared with the first embodiment in which the piping is formed in series.

Although, FIG. 3 does not show a part for supporting the metallic pipe 15, the metallic pipe 15 is movably supported so that the rollers 14*a* and 14*b* can be separated from the pressurizing roller 13, as in the first embodiment.

The supporting mechanism is not disposed in the fixing apparatus B but in the image forming device A. Accordingly, replacement and maintenance of the fixing apparatus B can be performed while the rollers 14*a* and 14*b* are separated from the pressurizing roller 13.

Therefore, the fixing apparatus B can be removed from the image forming device A with all of the piping/conduits of the cooling loop 9 remaining in the image forming device A. This arrangement can enable easier replacement work as compared with the first embodiment in which the fixing apparatus B is removed after dividing the cooling loop 9 by disconnecting the one-touch joints 24 and can further reduce the running cost of the device.

Third Exemplary Embodiment

Figure 5:
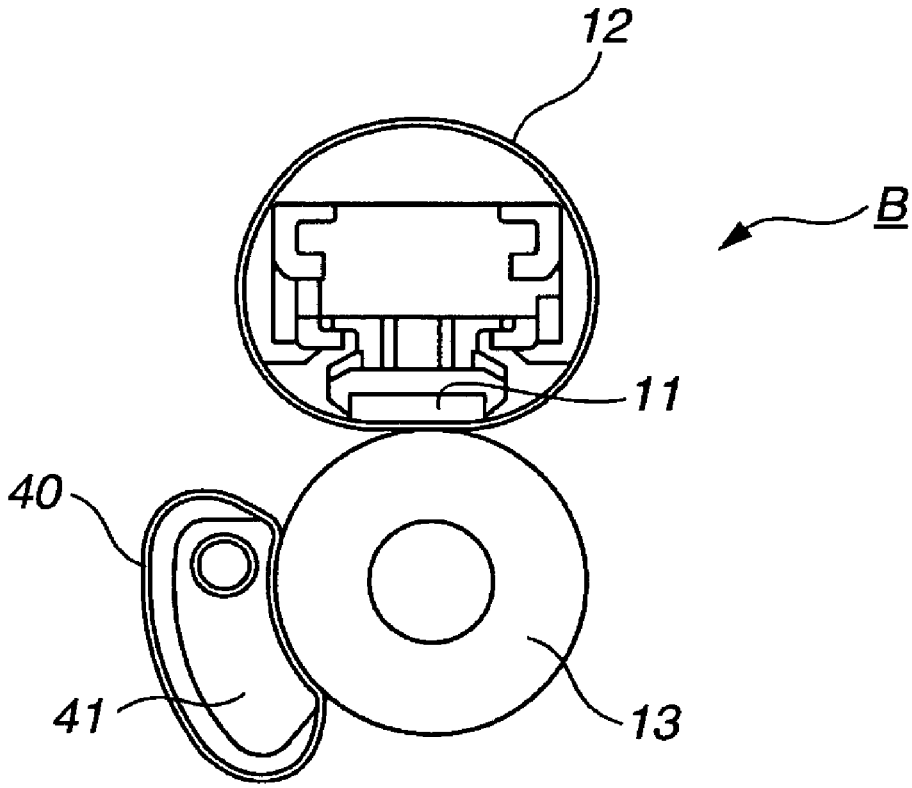
FIG. 5 is a sectional view of an exemplary fixing apparatus according to a third embodiment.
Figure 6:
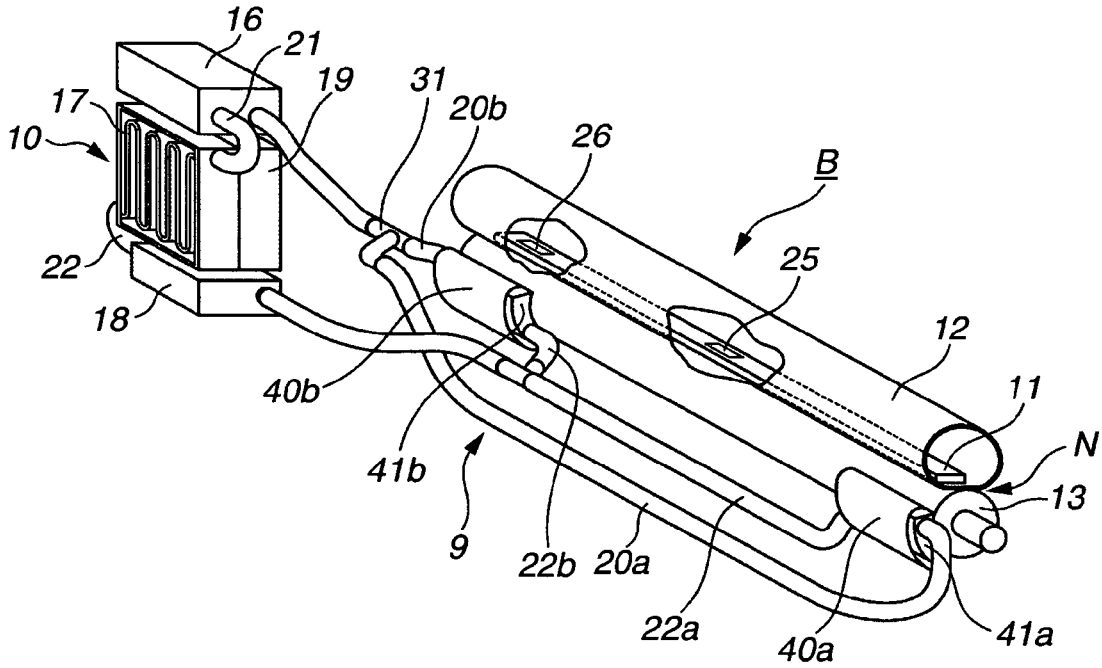
FIG. 6 is a sectional view of the proximity of the fixing apparatus according to the third embodiment.

Next, with reference to FIGS. 5 and 6, a fixing apparatus B according to a third embodiment is described. FIG. 5 is a sectional view of the fixing apparatus B according to the third embodiment. FIG. 6 is a sectional view of the proximity of the fixing apparatus B according to the third embodiment. Constituent parts identical or equivalent to the first embodiment and the second embodiment will not be described in the following description.

Heat dissipation pads 41, which function as cooling medium conduits which are components of the cooling loop 9, are configured to be in contact with both ends of the pressurizing roller 13 of the fixing apparatus B according to the present embodiment via respective cylindrical films 40 (heat transmission members). The cylindrical films 40 have high thermal conductivity and low thermal capacity. Each of the heat dissipation pads 41 is made of heat-resistant resin, and the inside of the pads 41 is formed with a conduit that meanders a number of times to increase a surface area. Each of the cylindrical films 40 is provided rotatably on an outer circumference of the heat dissipation pad 41.

Tubes 20*a* and 20*b* are connected to outlets of the heat dissipation pads 41*a* and 41*b*, at the ends of the fixing apparatus B respectively as shown in FIG. 6. Tubes 20*a* and 20*b* converge at the coupling 31, and from there are connected to the reservoir tank 16, the radiator 17, and the pump 18, respectively. Then, an outlet of the pump 18 is connected to inlets of the heat dissipation pads 41*a* and 41*b* via tubes 22*a* and 22*b* on the side of a center of the fixing apparatus B, respectively.

The heat dissipation pads 41 and the films 40*a* and 40*b* are configured to be movable by a mechanism (not shown) so that the films 40*a* and 40*b* can be brought into contact with the pressurizing roller 13 and separated from the pressurizing roller 13. Antifreeze solution that contains ethylene glycol is enclosed inside the thus formed channels as a cooling medium. It is also recognized that other cooling medium may also be used in the cooling loop 9.

When the pressurizing roller 13 rotates, each of the films 40 is driven to rotate around the heat dissipation pad 41 that serves as an axis. Since the film 40 slides on the fixed heat dissipation pad 41, moving parts are not required as the cooling loop 9.

Similar to the first embodiment, when excessive temperature rise at the ends of the fixing apparatus B is detected, the films 40 contact the pressurizing roller 13, and the pump 18 rotates to circulate the cooling medium. Thus, the heat at the ends of the fixing apparatus B can be emitted out of the image forming device A.

According to the present embodiment, each of the heat dissipation pads 41 located at the ends of the fixing apparatus B includes conduit having the large surface area, and each of the films can be made remarkably smaller in thermal capacity than the roller 14 described in the first and second embodiments. Therefore, the heat can be transferred from the pressurizing roller 13 to the cooling medium more efficiently than when the rollers 14*a-b* are used. Accordingly, the ends of the fixing apparatus B can be cooled efficiently, and the excessive temperature rise can be prevented. This results in improvement of the throughput of the image forming device B that is subject to reduction originating from the temperature rise at the ends of the device.

According to the present embodiment, each of the heat dissipation pads 41 located at the ends of the fixing apparatus B includes conduit having the large surface area, and each of the films 40 can be made remarkably smaller in thermal capacity than the rollers 14*a* and 14*b* described in the first and second embodiments. Therefore, the heat can be transferred from the pressurizing roller 13 to the cooling medium more efficiently than when the rollers 14*a* and 14*b* are used. Accordingly, the ends of the fixing apparatus B can be cooled efficiently, and the excessive temperature rise can be prevented. This results in improvement of the throughput of the image forming device A that is subject to reduction originating from the temperature rise at the ends of the device.

According to the above embodiments, the fixing apparatus B serves as an image heating device and fixes a toner image formed on a sheet; however, the present invention is also applicable to a device which preheats a toner image formed on a sheet. In this case, the preheated toner image on the sheet is fully fixed by a fixing apparatus provided separately. Further, each of the above embodiments describes the structure in which the fixing film serving as the heating rotor is cooled indirectly via the pressurizing roller; however, a cooling unit may also be configured to cool the heating rotor directly.

According to each of the above embodiments, the excessive temperature rise of the heating rotor can be prevented. Further, the productivity of the image heating apparatus can be improved.

According to each of the above embodiment, the excessive temperature rise of the heating rotor can be prevented. Further, the productivity of the image heating apparatus can be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-031239 filed Feb. 8, 2005, which is hereby incorporated by reference herein in its entirety.

What is claimed is:

1. An image heating apparatus comprising:

a rotatable heating member adapted to heat an image on a recording material at a nip portion; and a cooling unit adapted to cool the heating member, the cooling unit including a pipe through which fluid circulates, and a cooling member slidably and rotatably disposed around the pipe.

2. The image heating apparatus according to claim 1, the cooling member adapted to be separated from the heating member.

3. The image heating apparatus according to claim 1, the cooling unit including a cooling mechanism adapted to circulate the fluid in the pipe and to cool the fluid.

4. The image heating apparatus according to claim 3, wherein the cooling mechanism is turned on or off according to a widthwise length of the recording material.

5. The image heating apparatus according to claim 3, the cooling unit including at least one connection part adapted to connect/disconnect the pipe from the cooling mechanism.

6. An image heating apparatus comprising:

a rotatable heating member configured to heat an image formed on a recording material at a nip portion; and a cooling unit adapted to cool the heating member, the cooling unit including a pipe through which a cooling medium circulates, and a cooling member slidably and rotatably disposed around the pipe, wherein the pipe is configured to be adjustably positioned proximate, in a parallel orientation, adjacent the rotatable heating member, wherein the cooling member is adjustably configured to be in contact with an outer surface of the rotatable heating member.

7. The image heating apparatus according to claim 6, the cooling member configured such that the cooling member may be separated from the heating member.

8. The image heating apparatus according to claim 6, the cooling unit including a cooling mechanism adapted to circulate the cooling medium through the pipe for cooling the cooling medium.

9. The image heating apparatus according to claim 8, wherein the cooling mechanism is turned on/off according to a widthwise length of the recording material.

10. The image heating apparatus according to claim 8, the cooling unit including at least one connection part adapted to connect/disconnect the pipe from the cooling mechanism.

* * * * *